US006343393B1

(12) United States Patent
Chow

(10) Patent No.: US 6,343,393 B1
(45) Date of Patent: Feb. 5, 2002

(54) WATERBED STRUCTURE

(76) Inventor: Andy S. Chow, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/677,173

(22) Filed: Oct. 2, 2000

(30) Foreign Application Priority Data

Oct. 8, 1999 (TW) ..... 88217112 U

(51) Int. Cl.[7] ..... A47C 27/10
(52) U.S. Cl. ..... 5/681; 5/683; 5/685
(58) Field of Search ..... 5/681, 683, 685, 5/675

(56) References Cited

U.S. PATENT DOCUMENTS 4,292,702 A * 10/1981 Phillips ..... 5/683
4,329,748 A * 5/1982 Finkelstein ..... 5/683
4,700,419 A * 10/1987 Santo ..... 5/681
5,727,269 A * 3/1998 Chung ..... 5/681
5,740,573 A * 4/1998 Boyd ..... 5/685
5,845,353 A * 12/1998 Chow ..... 5/681

* cited by examiner

*Primary Examiner*—Alexander Grosz
(74) *Attorney, Agent, or Firm*—Troxell Law Office PLLC

(57) ABSTRACT

An improved waterbed having a waterbed mattress and a bed protecting cover with airbag protecting sides. The waterbed mattress has a plurality of internal, transverse partitions welded by high-frequency heat sealing, arranged at intervals in single or double rows, with water openings. When the water is filled and the air is inflated, the partitions buffer the water forces to increase the stability and maintain the bed mattress firm, straight and in shape. The level of compressing force towards the waterbed mattress can be changed by increasing or decreasing the air pressure in the airbag protecting sides to adjust the softness and hardness of the waterbed mattress.

2 Claims, 5 Drawing Sheets

WATERBED STRUCTURE

BACKGROUND OF THE INVENTION

1) Field of the Invention

The invention relates to an improved waterbed structure, more specifically, a waterbed with a high degree of stability, adjustable softness and hardness, firm and sturdy, free of water leakage, and which can be easily and efficiently manufactured in terms of saving time and labor to reduce the production costs.

2) Description of the Prior Art

The elements of a conventional waterbed are mostly welded by high-frequency heat sealing. In most designs, inside the waterbed mattress, there are several connected or properly divided water bags filled with water. However, when the user lies down on the bed, or exercises on th e bed, pressure is applied to cause a sudden compress ion force producing a water rush to sway the bed mattress. Therefore, not only the stability is less, but also the excessive water pressure will damage the sealing edges of the high-frequency heat sealing of the waterbed causing water leakage. Furthermore, most of the convention al waterbeds cannot efficiently keep the frame of the waterbed mattress in a firm shape, not only resulting in the deforming of the water-filled bed mattress and loosening the cover materials, but also effecting the duration of usage of the sealed edges, resulting in failure of an aged water bed mattress. For example, as shown in FIG. 5, a conventional waterbed (1), has between the top packing wall (10) and the bottom packing wall (11), a plurality of x-shaped partitions (12) fastened longitudinally in parallel defining a plurality of respective water bag chambers (13). However, the quick water rush produced by the heavy compression force applied to the water bag chambers (13) and the lack of strong protective frame will cause the bed mattress to sway and deform. Additionally, because the x-shaped partitions (12) are welded respectively by high-frequency heat sealing to the top and bottom packing walls (10) and (11), the water pressure in the water bag chambers (13) will continually and heavily push the adjacent airbag side partitions (14), resulting in damage to the sealing-welded edge structure, causing the water to leak into the air bag cavity (15).

Therefore, the inventor of the invention obtained U.S. Pat. No. 6,035,470. Although the previous invention improved many shortcomings of the conventional waterbeds, the volume of the waterbed mattresses was quite big and required a large heat sealing welding machine to smoothly operate the high-frequency heat sealing process, which consumed large manpower and labor time to accomplish manufacture. Therefore, for all the aforesaid conventional waterbed structures, not only do the welded sealing edges tend to be damaged by the imbalance between air pressure and water pressure due to the user's pressure or sudden compression force on the water-filled bed, but also the processes of welding the edges by heat sealing and assembly are too complicated, thus failing to efficiently reduce the number of processing steps and to simplify the assembly production process.

SUMMARY OF THE INVENTION

The primary objective of the present invention is to provide an improved waterbed structure, with adjustable softness and hardness, capable of maintaining the bed mattress firm and stable, and which efficiently reduces the processes of welding by heat sealing and assembly manufacture to lower the production costs and enhance the quality control. The improved waterbed comprises a waterbed mattress constructed by an outer packing wall and partitions welded by heat sealing to the inside of the packing wall; a bed protecting cover, attached with airbag protecting sides, the airbag protecting sides encircling and forming a receiving shell for the waterbed mattress. By increasing or decreasing the pressure in the airbag protecting sides a user can adjust the softness and the hardness of the waterbed, and the buffering of the partitions will stabilize the waterbed mattress. The design of the independently divided waterbed mattress and the airbag protecting sides, simplifies the processes of assembly and welding to lower the production costs of manufacturing the whole waterbed unit.

Another objective of the invention herein is to provide an improved waterbed structure which can, even when improper compression force is applied to the waterbed mattress cause split seams resulting in water leakage, still efficiently offer control from the outside covering to prevent the water from leaking out.

To enable a further understanding of the said objectives, the technological methods and the efficiency of the invention herein, a best application example is followed by drawings and detailed description of the preferred embodiment.

DETAILED DESCRIPTION OF THE PREFERRED EMBODIMENT

Figure 1:
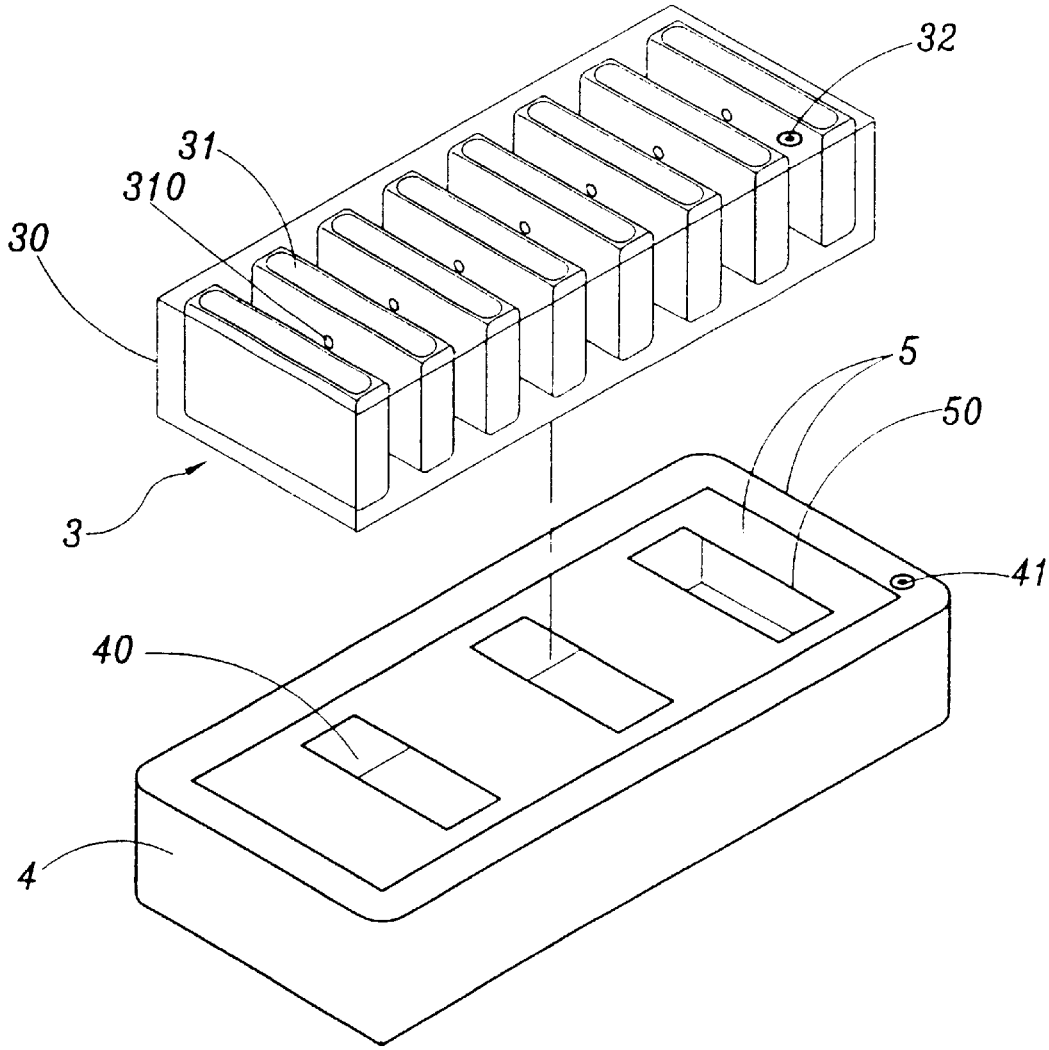
FIG. 1 is an exploded pictorial isometric drawing of a single waterbed of the invention herein.
Figure 2:
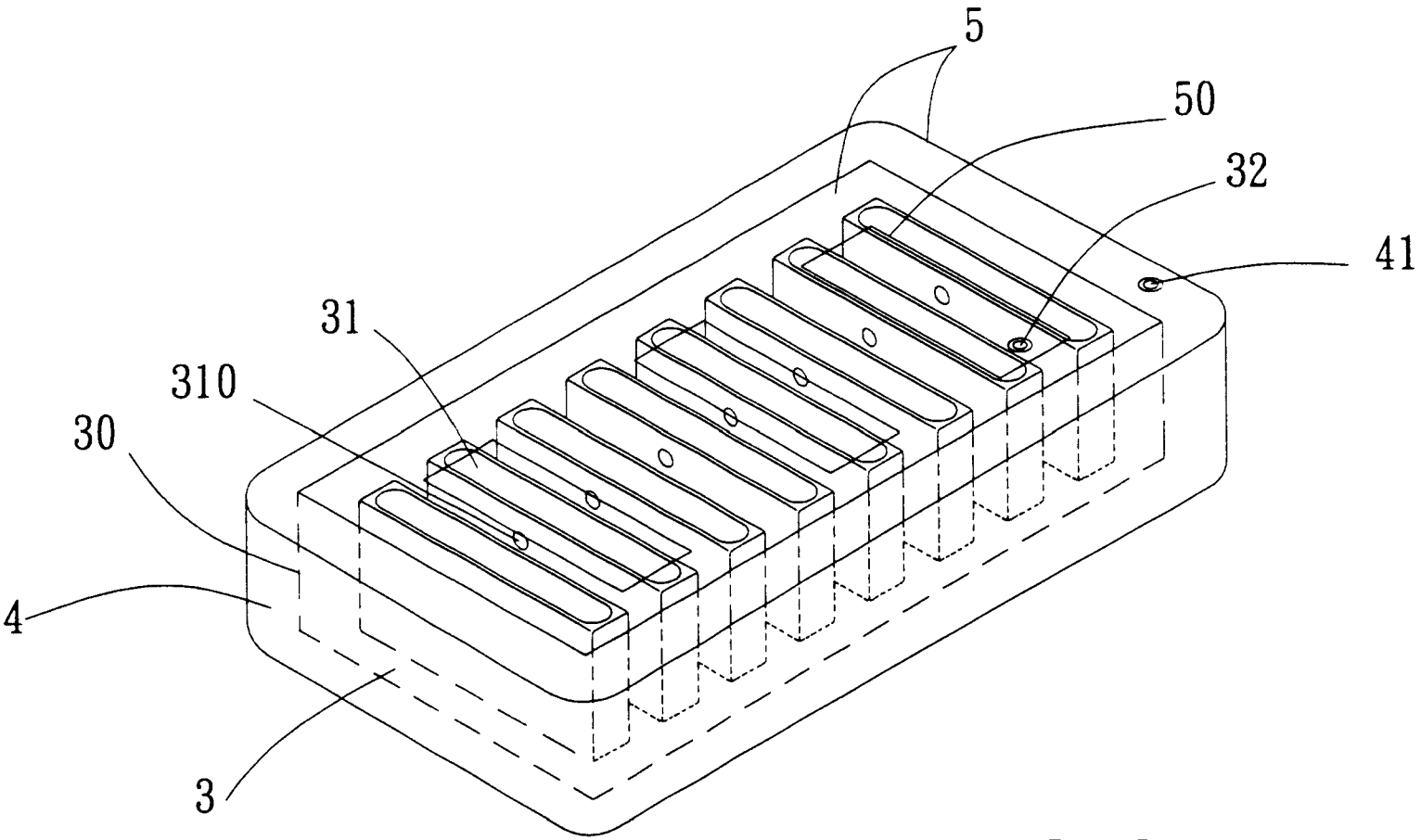
FIG. 2 is a pictorial isometric drawing of an assembled single waterbed of the invention herein.

Referring to FIGS. 1 and 2, the exploded and assembled isometric drawings of the improved waterbed structure of the invention herein, the waterbed structure comprises a waterbed mattress (3) and a bed protecting cover (5) having airbag protecting sides (4) in rolls.

The waterbed mattress (3) includes an outer packing wall (30) and a plurality of transverse partitions (31) with at least one water inlet (32) on the waterbed mattress (3) for the user to fill water into the waterbed mattress (3). The plurality of transverse partitions (31) are made of plastic materials such as PVC, and are mounted respectively inside the outer packing wall (30), in a single row arrangement for a single bed, and two rows on the left and right sides for a double bed. Every transverse partition (31) is formed into a hollow cylinder transversely arranged in parallel with water openings (310) on longitudinal surfaces. The top and bottom rims of the transverse partitions (31) are welded by high-frequency heat sealing to the insides of top and bottom walls of the outer packing wall (30) defining a waterbed mattress (3).

Figure 3:
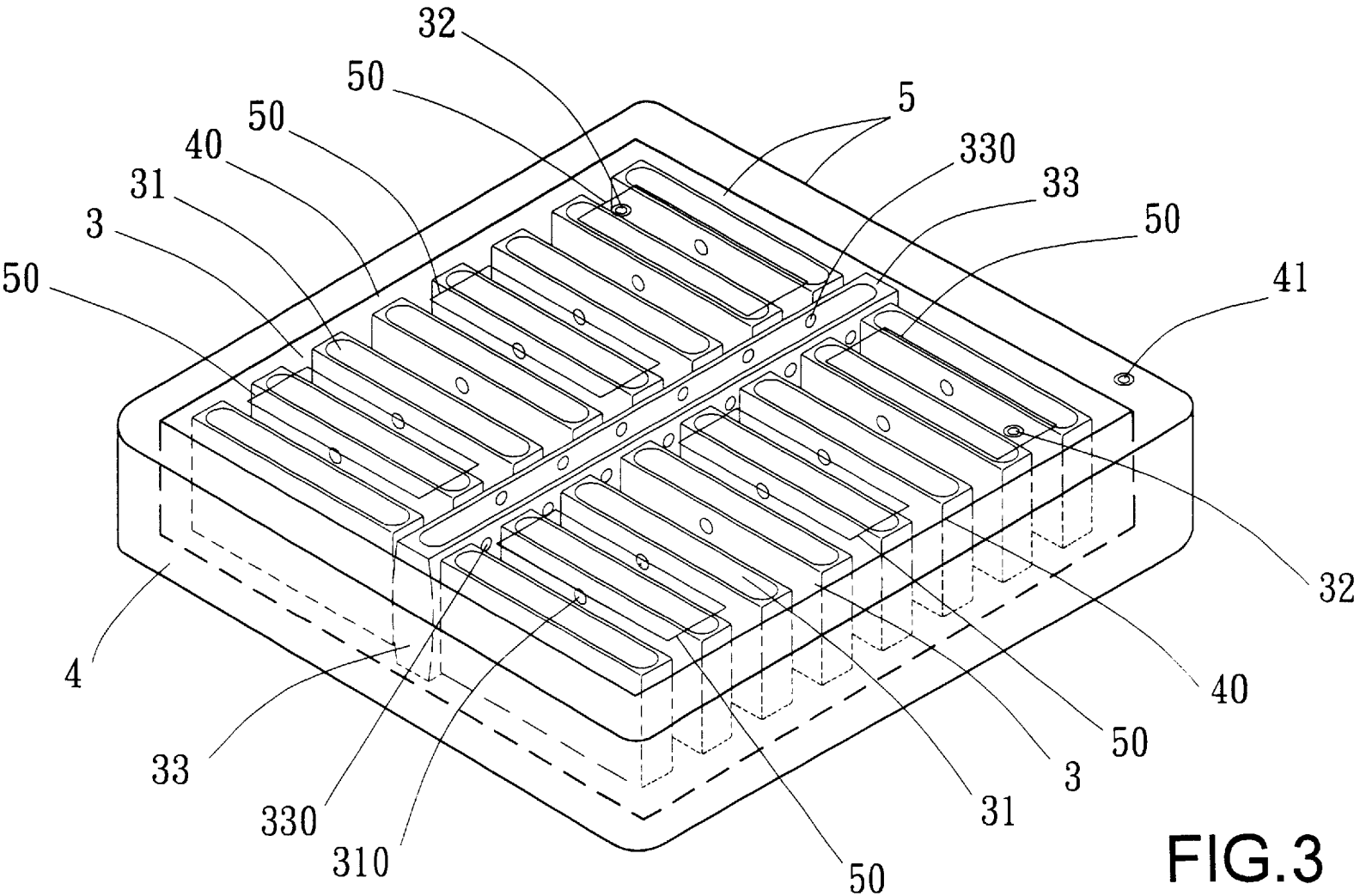
FIG. 3 is a pictorial isometric drawing of a double waterbed constructed according to the invention herein.

For the single waterbed mattress (3), shown in FIGS. 1 and 2, a single row of a plurality of transverse partitions (31) is mounted. For the double waterbed (3), shown in FIG. 3, two rows of transverse partitions (31) are mounted on the left and right sides. Furthermore, another longitudinal partition (33), can be mounted longitudinally in between the two rows. As with the transverse partitions (31), the centered longitudinal partitions (33) are also made of the plastic materials, such as PVC, and formed into hollow cylinders, longitudinally arranged in parallel, with a plurality of asymmetrical water openings (330) on the left and right sides on the transverse surface. The top and bottom rims of the centered longitudinal partitions (33) are welded by high-frequency heat sealing to the top and bottom walls inside of the outer packing wall (30).

Figure 4:
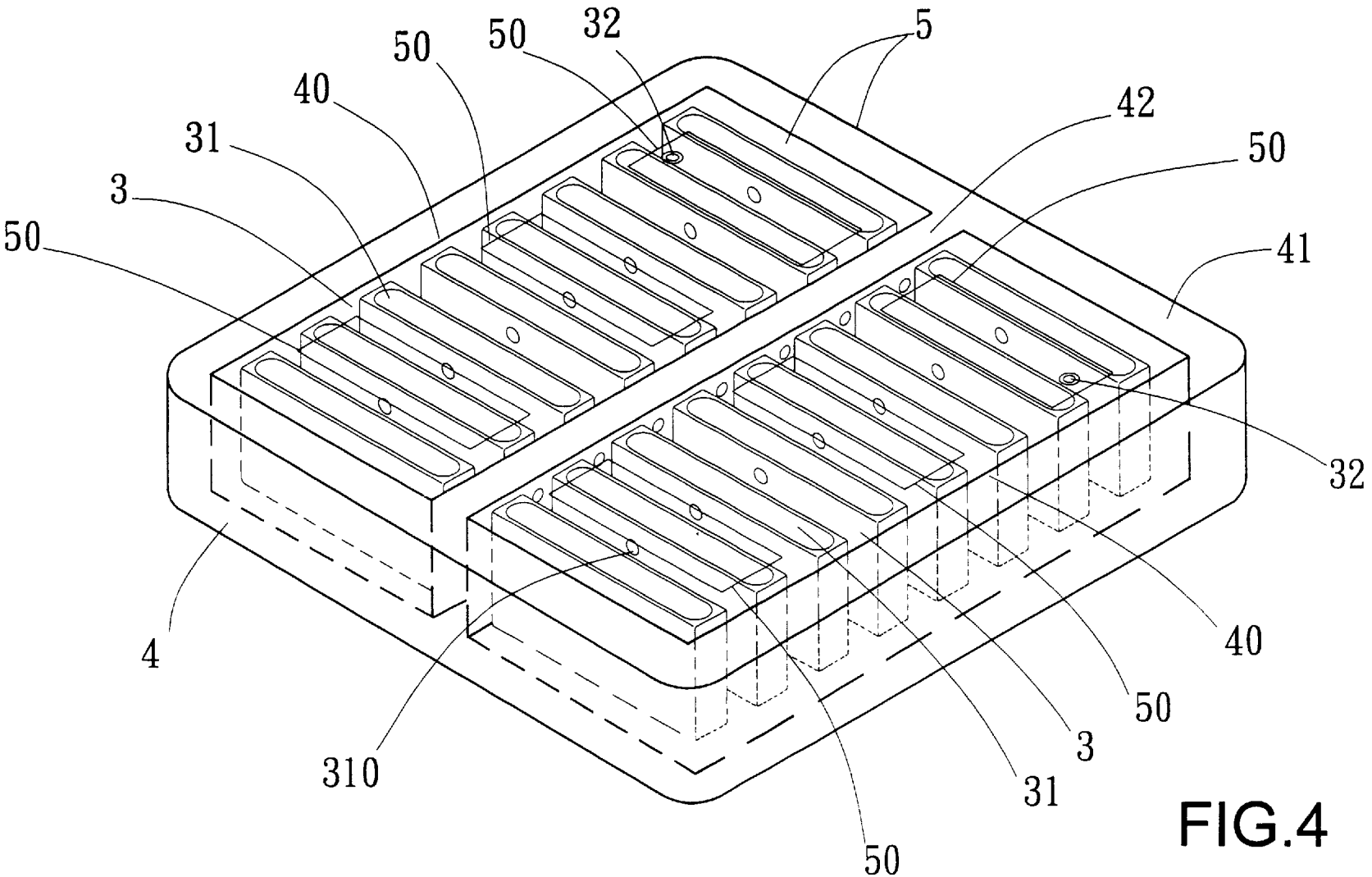
FIG. 4 is another pictorial isometric drawing of a double-size bed with two single waterbed mattresses constructed according to the invention herein.
Figure 5:
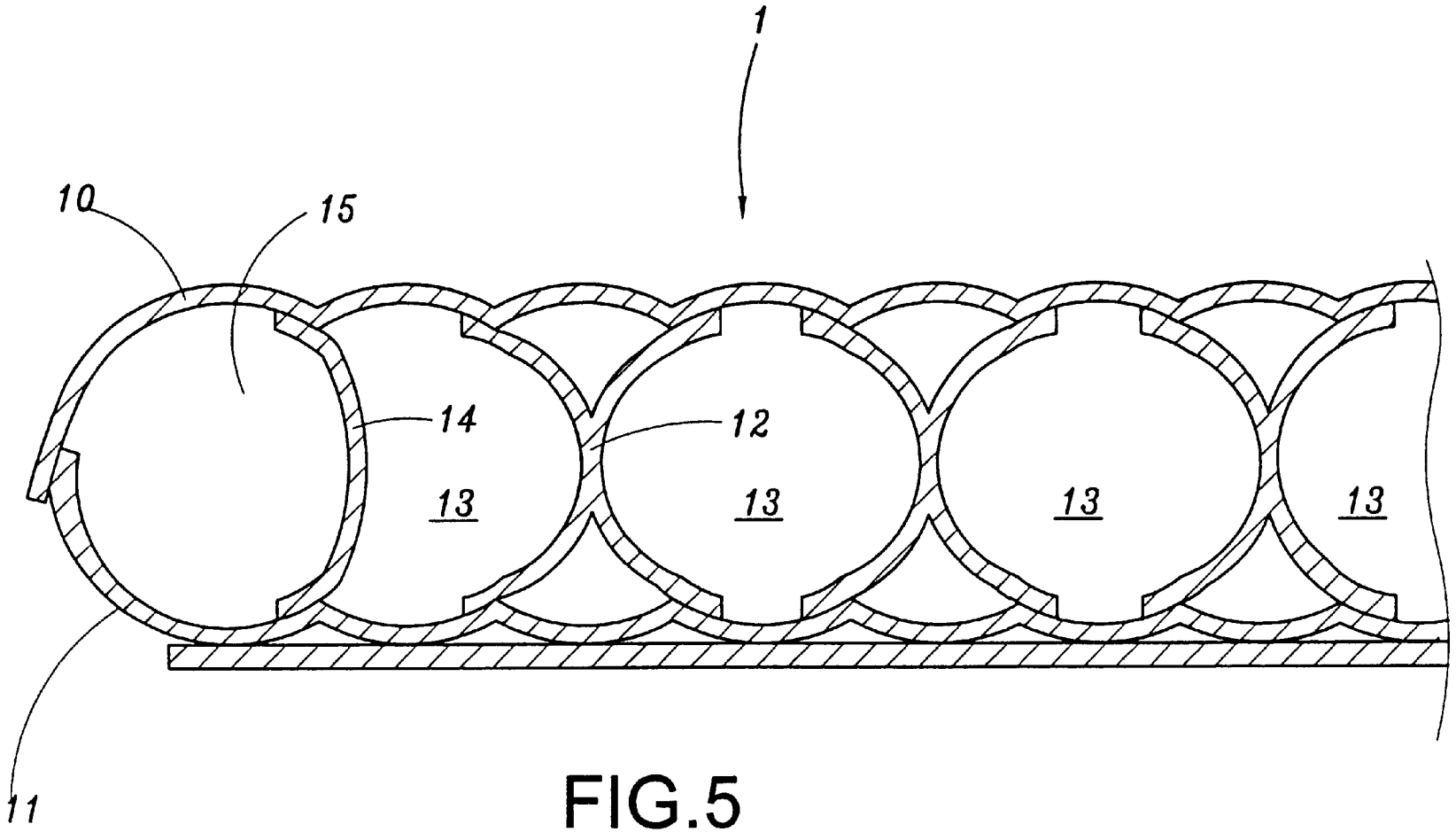
FIG.5 Prior Art
FIG. 5 is a cutaway isometric drawing of a conventional waterbed structure.

A plurality of oblong holes (50) are located on the top of the bed protecting cover (5) for putting in or picking up the collapsed and pressed waterbed mattress (3) before filling the water or after draining the water. The water inlets (32) are located right at the oblong holes (50) area for conveniently filling the water into or draining off the water from the waterbed mattress (3). Four sides of the bed protecting cover (5) are encircled and attached with rolled airbag protecting sides (4) to form a receiving shell (40) for installing the waterbed mattress (3). There is at least one air inflating plug (41) on the airbag protecting sides (4). As shown in the FIGS. 1–3, a plurality of oblong holes (50) are located on the bed protecting cover (5) for installing a single waterbed mattress (3) or a double waterbed mattress (3) or, as shown in FIG. 4, to connect a longitudinal airbag partition (42) at the center of the bed protecting cover (5) to form a receiving shell (40) for receiving two single waterbed mattresses (3).

Therefore, when inflated, the airbag protecting sides (4) will efficiently encircle and fasten the four sides of the waterbed mattress (3) and maintain the shape firm and straight to avoid the deformation and cover material loosening under the pressure, so as to stabilize the waterbed mattress (3) to reduce swaying. The sides also can protect the seam lines welded by heat sealing for better duration and to prevent water leakage. Furthermore, hook and loop belts and zippers can be fastened to the edge sections of the bed protecting cover (5) for freely adding or attaching other thinner mattresses on the bed to increase the hardness of the bed or to fulfill related medical or hygienic purposes. Furthermore, by supplementing or exhausting the net volume in the airbag protecting sides (4) to increase or decrease the pressure to change the rate of compression force from the airbag protecting sides (4) towards the waterbed mattress (3), to easily adjust the softness and hardness of the whole waterbed.

The invention herein utilizes the transverse partitions (31) or the centered longitudinal partitions (33) to reduce the vibration caused by the pressure produced by the user lying down or the water rush wave produced by sudden compression force from exercising on the bed, to increase the stability of the bed mattress (3). For the double bed structure with larger volume and size, the centered longitudinal partitions (33) can block the vibration caused by the collision force of the transverse water flow when the left and right sides are under pressure. Furthermore, the asymmetrical water openings (330) on the left and right sides can buffer the pressure from the water flow, therefore efficiently enhancing the stability of the double bed.

Whether for the single bed or double bed, the waterbed mattress (3) is directly installed into the receiving shell (40) between the inflated airbag protecting sides (4) or, into the receiving shell (40) parted by the airbag protecting sides (4) and the centered airbag partition (42) by assembling separately to form the single bed mattress (3) or a double mattress (3). Therefore the airbag tubes and other related structure need not penetrate all the transverse partitions (31) or, as the four sides of airbag structure of the other conventional waterbed, be directly welded by heat sealing to the water bag chambers. This greatly reduces large manpower requirements and the production costs. The airbag protecting sides (4) need no direct welding to the waterbed mattress (3), so there is no imbalance between the air pressure and the water pressure when the waterbed mattress (3) is under pressure and directly presses the protecting sides (4). This reduces resulting damage to the seam lines welded by heat sealing of all the structural elements, efficiently reducing the inferior rate of the products and enhancing the product quality of the waterbeds.

Another worthwhile feature of the present invention is that the waterbed mattress (3) is assembled separately and installed in the receiving shell (40) encircled by the four sides of the airbag protecting sides (4) of the bed protecting cover (5). Therefore, in case of improper pressure application breaking the waterbed mattress (3) and causing the water leakage, the leaking water can be completely contained by the bed protecting cover (5) instead of flowing out of the bed unit. Thus the user can immediately pump out the water, repair, replace or take other further proper solving steps.

In summation of the foregoing section, the improved waterbed of the invention is able to maintain the stability of the waterbed mattress while the user is lying down and to easily adjust the softness and the hardness. It also reduces the production costs of labor and materials, and prevents the seam lines welded by heat sealing from damage.

What is claimed is:

1. A waterbed comprising:

a) a waterbed mattress having an outer wall, a plurality of separate, transverse partitions arranged two rows within the outer wall, each partition having two spaced apart partition walls, each partition wall with at least one water opening therethrough, the outer wall including at least one water inlet;

b) a bed protecting cover in which the waterbed mattress is located, the bed protecting cover having airbag protecting sides encircling lateral portions thereof, an upper surface of the bed protecting cover having a plurality of elongated holes through which the waterbed mattress may be inserted into and withdrawn from the bed protecting cover, the airbag protecting sides including at least one inflating plugs and at least one longitudinal partition located between the two rows of transverse partitions, the at least one longitudinal partition having two spaced apart side walls each with a plurality of water openings therethrough.

2. The waterbed of claim 1 wherein the plurality of water openings in one of the partition walls are asymmetrical with respect to the plurality of water openings in the other of the partition walls.

* * * * *